United States Patent [19]

Fanget

[11] Patent Number: 4,662,796

[45] Date of Patent: May 5, 1987

[54] SUPPORTING PILLAR FOR MINES

[75] Inventor: Paul Fanget, Andrezieux Boutheon-Loire, France

[73] Assignee: Bennes Marrel, France

[21] Appl. No.: 580,536

[22] Filed: Feb. 15, 1984

[30] Foreign Application Priority Data

Feb. 16, 1983 [FR] France ..... 83 02800

[51] Int. Cl.[4] ..... E21D 15/44

[52] U.S. Cl. ..... 405/296; 405/297

[58] Field of Search ..... 405/291, 295, 296, 297; 299/33

[56] References Cited

U.S. PATENT DOCUMENTS

| | | | |
|---|---|---|---|
| 4,136,999 | 1/1979 | Koppers | 405/295 |
| 4,236,850 | 12/1980 | Koppers et al. | 405/291 |
| 4,382,722 | 5/1983 | Romanowicz | 405/291 |

FOREIGN PATENT DOCUMENTS

| | | | |
|---|---|---|---|
| 2507263 | 9/1976 | Fed. Rep. of Germany | 405/296 |
| 2657955 | 6/1978 | Fed. Rep. of Germany | 405/295 |
| 2031496 | 4/1980 | United Kingdom | 405/295 |

*Primary Examiner*—David H. Corbin

*Attorney, Agent, or Firm*—Remy J. VanOphem

[57] ABSTRACT

The invention relates to a travelling support pillar for use in underground mines.

The support pillar has a link subjected to the action of a positioning jack. The positioning jack extends between a gate and the rear of the top of the pillar. The positioning jack hydraulically locks the support pillar by means of a sliding pressure-relief valve to compensate for load changes due to the movement of the floor or the roof. The link also permits the support pillar to be collapsed for transportation, and it provides a support pillar with a shorter length and a lower height in the collapsed position, and it permits the top of the support pillar to be placed closer to the working face of the mine when the pillar is in its roof supporting extended position.

3 Claims, 12 Drawing Figures

SUPPORTING PILLAR FOR MINES

BACKGROUND OF THE INVENTION

1. Field of the Invention

This invention relates to a supporting pillar of the type called a "travelling support." More particularly, this invention relates to a supporting pillar which is intended for use in underground mines.

It is known that a travelling supporting pillar usually includes a sole plate that is intended to bear against the floor, and a top that is intended to be applied against the roof, with hydraulic jacks acting as stanchions inserted between the sole plate and the top. In some pillars, a gate or a shield is inserted between the sole plate and the top with the end of the shield joined to the top to protect the rear of the pillar against rock falls that may be caused by cave-ins or fill-ups.

2. Description of the Prior Art

French Pat. No. 2,263,370 describes a pillar including a gate where a pivoting lever 6 is inserted between the end 7 of the gate 2 and the top 5 such that a jack 9 can move whenever it is not hard against the roof. This enables the top 5 to be positioned very close to the working face 22 before sending the load into the stanchions 4 that support the pillar against the roof. This prior art device is intended to correct the articulation movements which are characteristic of pillars that are equipped with a gate at times when the pillar is not tightened against the roof. In fact, when the gate in such a prior art pillar is joined directly to the rear of the sole plate, its forward end tends to describe an arc of a circle, and this will usually result in an increased distance between the top 5 and the working face, especially when the thickness of the seam is greater. The presence of the hinged lever 6 and its jack 9 allows correction for this effect, and for conveniently locating the top 5 with reference to the working face 22, before the tightening of the pillar against the roof. However, after the tightening of the pillar to the roof, the lever 6 remains positively locked on the gate 2, by an undeformable mechanism (notched sector 30, pin 31, eyelet 32, locking hole 33). In other words, the object of the device described in French Pat. No. 2,263,370 is to prevent any relative displacement of the top 5 with reference to the gate 2, other than a pivoting about the axis 8.

However, the aforesaid prior art device has certain disadvantages:

the supporting pillar may have a considerable height and length, which makes it difficult to transport the pillar to the bottom of the mine, requiring, consequently, a great amount of time for installation in the mine; and the supporting pillars that are pressed against the top are often subjected by the relative movements of the walls, to stresses whose direction does not always correspond to the sliding direction of the pillar, resulting in the development of substantial stress components directed forwards or backwards of the support, and these can cause slippage of the top on the roof or of the sole plate on the floor. As a result, the loads on the frame of the pillar, especially the rear links, are often substantial. These forwardly and backwardly directed stresses of the pillar can also appear during the tightening of the pillar if the sole plate is not on a stable support, and this can result in damage to the pillar or an inadequate support.

SUMMARY OF THE INVENTION

An object of the present invention is to avoid the disadvantages of the prior art by providing a travelling support pillar which has a smaller length and height with the same operating capacity and which can accept and follow the movements of the floor, when the top of the pillar is pressed against the roof without resulting in damage to the pillar, and without creating an excessive concentration of stresses.

A travelling supporting pillar according to the present invention includes hydraulic stanchions arranged between a lower sole plate and a top and links articulated on a sheild or gate at the rear of the sole plate and top. The support pillar is characterized by a positioning link with three articulation axes that is articulated between the rear of the top and the top end of the shield or gate One of the axes is carried by the rear of the top, the second by the end of the shield, and the third by the end of a positioning jack supported outside the positioning link.

Another characteristic of the present invention is that the positioning jack is supported on the lower surface of the shield or gate.

Yet another characteristic of the present invention is that the positioning jacket is supported under the top.

Yet another characteristic of the present invention is that the positioning jack is articulated at an axis in the middle part of the positioning link, and the two ends of the positioning link are articulated with respect to the top and to the shield or gate, respectively.

According to another characteristic of the invention, the positioning jack is articulated at an axis through the lower end of the positioning link, the central part of which is articulated at an axis through the shield or gate, and whose top end is articulated at an axis through the rear of the top.

The locking of the top of the supporting pillar according to the present invention to the shield or gate of such supporting pillar is by hydraulic pressure applied by the positioning jack in whose hydraulic circuit there is permanently placed a sliding or overpressure valve of known type. By means of this arrangement, whenever the top is pressed against the roof, the relative movements between the floor and the roof can be followed without damage to the frame of the pillar. Such relative movement, when of small amplitude, will result in a moderate hydraulic overpressure in the positioning jack, but greater relative movements between the floor and the roof will cause a limited discharge of hydraulic liquid by the sliding valve without any interruption of the support.

In an alternative embodiment of the present invention, the positioning jack is replaced by a resilient system which includes a spring, silent block, hydraulic accumulator and/or a mechanical blocking system with a built-in stress limiter.

It will be understood that the supporting pillar according to the present invention provides a particularly effective permanent support, even in very unstable mines, and without damage to the pillar. It is applicable to supporting pillars of all types, including those with two, three or four stanchions.

The attached drawing, provided as a non-limiting example, will allow a better understanding of the invention.

DETAILED DESCRIPTION OF THE PREFERRED EMBODIMENT

Figure 1:
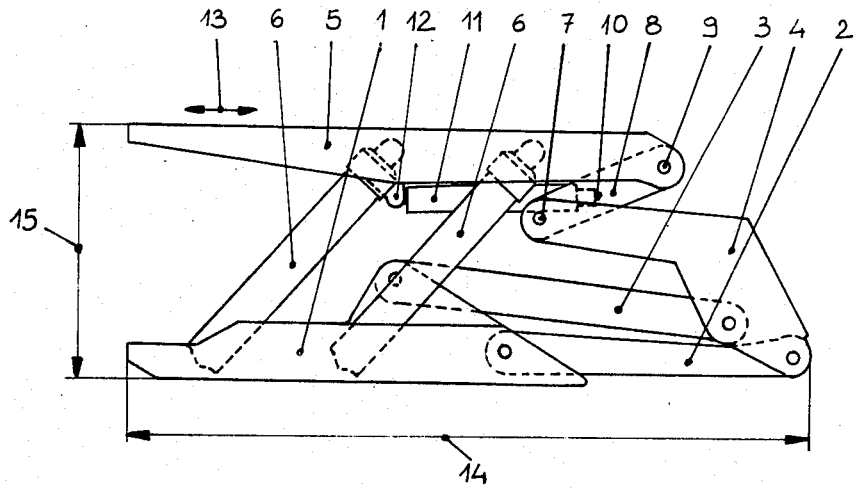
FIGS. 1 to 3 illustrate several successive stages of the unfolding of a preferred embodiment of a supporting pillar according to the present invention.

The supporting pillar illustrated in FIGS. 1 to 4 includes, in the usual manner: one or two sole plates 1; one or two rear links 2; one or two front links 3; one or two shields or gates 4; one or two tops 5; and four stanchions consisting of main hydraulic jacks 6.

The pillar according to the invention also includes, at the end of the shield 4, an articulation axis 7 on which the bottom end of a link 8 is articulated. The work "link" 8 can also designate an assembly of several links side by side or also a single link-box.

The link 8 also has an articulation axis 9 at its top and the rear of the top is connected to the link 8 at the articulation axis 9.

The link 8 also has a third axis 10, that, in the embodiment of FIGS. 1 to 4, is located between the axes 7 and 9. One end of a hydraulic positioning jack 11 is articulated on the axis 10, and the other end of the positioning jack 11 is articulated on an axis 12 carried by the lower part of the top. Alternatively, the axis 12 may be placed on the top 5, for example, at the elevation of the stanchion 6, but placed forwardly thereof.

According to another characteristic of the invention, the positioning jack 11 serves to position the elevation of the top 5 while allowing the top to be longitudinally displaced along the direction indicated by the double arrow 13. For this purpose, the hydraulic positioning jack 11 is connected to a supply circuit, not shown, and the supply circuit includes a controlled one-way or no-return valve and an overpressure or sliding valve of known type. This arrangement maintains the pressure in the positioning jack 11 to insure the hydraulic locking of the link 8, as long as the pressure remains below a preset release threshold. If, due to a movement of the walls, an increased pressure appears in the hydraulic positioning jack 11, the sliding valve allows the discharge of a minimal quantity of hydraulic liquid, sufficient to reduce the pressure to an acceptable level, after which the valve will close to again insure the hydraulic locking of the link 8.

The operation of the supporting pillar of FIGS. 1 to 4 is as follows:

The pillar is folded, as shown in FIG. 1, when it is in its transport position. The presence of the link 8, according to the present invention, allows the reduction, to a minimum, of both the overall length 14 of the folded pillar and its space occupying height 15. The pillar may, therefore, be more readily transported to the bottom of the mine.

Figure 2:
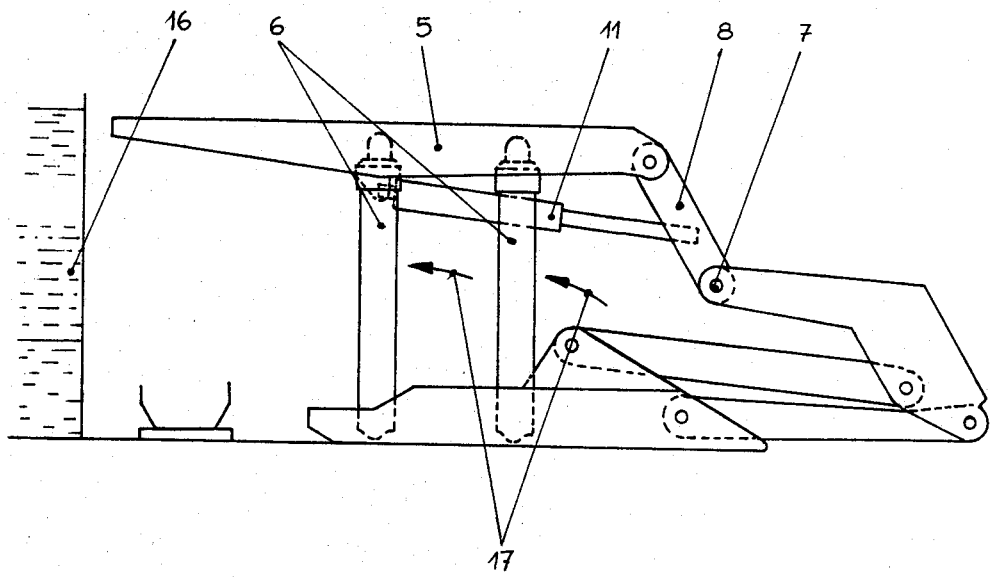
Figure 3:
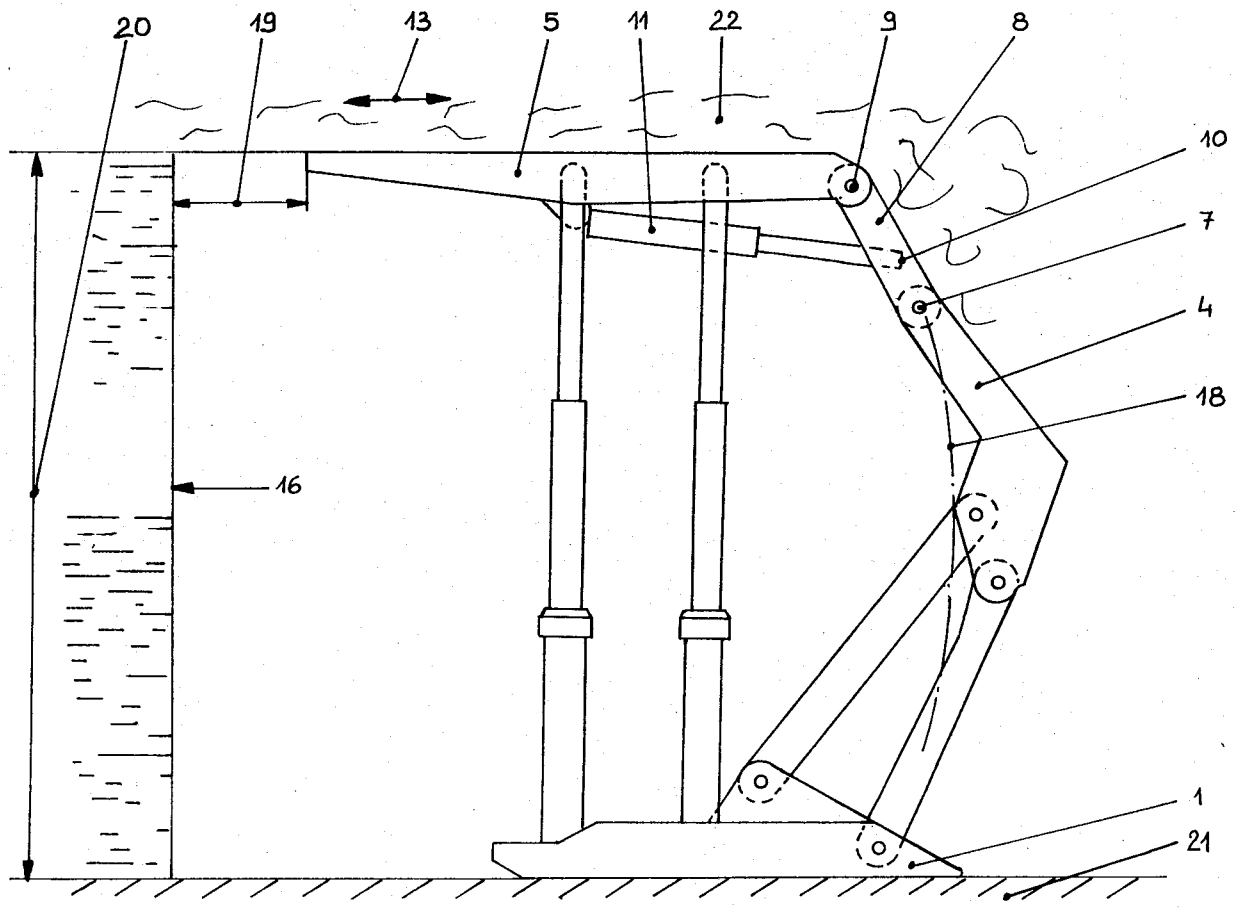

When the pillar is placed in front of a working face 16 of the mine, as is shown in FIG. 2, the positioning jack 11 is operated so as to elongate the pillar, and this causes the movement of the stanchions 6 to substantially vertical positions, as shown by the arrows 17 in FIG. 2.

Next, the stanchions 6 are elongated to press the top 5 against the roof. This leads to the articulation of the front and rear links 2 and 3 and, in turn, this causes the displacement of the axis 7 of the gate or shield 4, along a path shown by the curve 18 in FIG. 3. This curve differs slightly from a straight line, so that the distance 19, between the working face 16 and the front of the top 5, varies depending upon the height 20 of the coal seam.

Therefore, by acting on the length of the positioning jack 11 before the tightening of the top 5 against the roof, it is possible to vary and adjust this distance 19 to obtain the desired position of the pillar with respect to the working face 16.

Unlike the prior art support pillar devices, the support pillar device according to the present invention is able to function after the pillar has been tightened between the floor 21 and the roof 22, and it does this in a continuous manner whenever the pillar is tightened between the walls.

In practice, it is noted that as the roof 22 sinks with respect to the floor 21, it proportionally tends to increase the distance 19, that is it causes a backward movement of the top 5 with reference to the working face 16. Known supporting pillars resist this longitudinal movement of the top (arrow 13), but this has the effect of generating increasingly enormous loads in the support pillar which can damage the frame of the support. The support pillar device according to the present invention, on the other hand, allows a backward movement of the top 5 (increase of the distance 19), while maintaining an efficient support for the roof 22.

Figure 4:
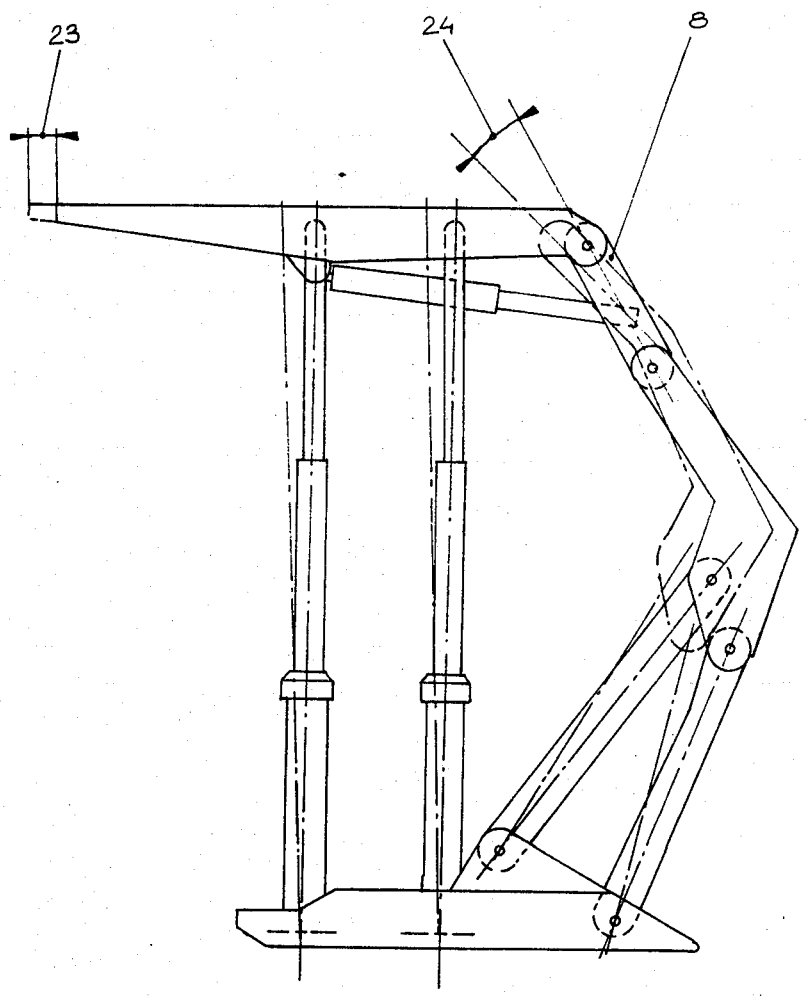
FIG. 4 illustrates the functioning of the supporting pillar of FIGS. 1 through 3 in the case of the longitudinal displacement of the floor relative to the roof.

Such backward movement or longitudinal displacement, for example, of the amplitude 13 as illustrated in FIG. 4, can occur with a simple angular displacement of the link 8.

Figure 5:
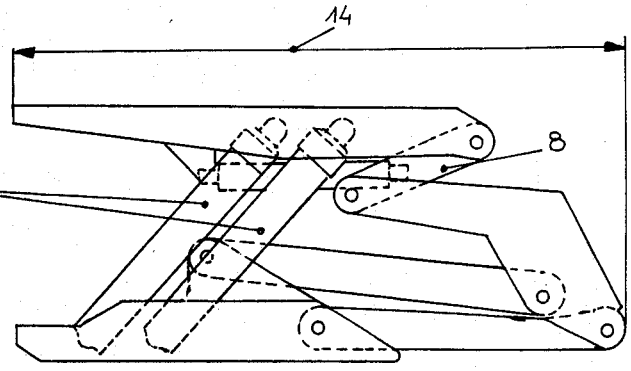
FIGS. 5 to 8 illustrate an alternative embodiment of the present invention.
Figure 6:
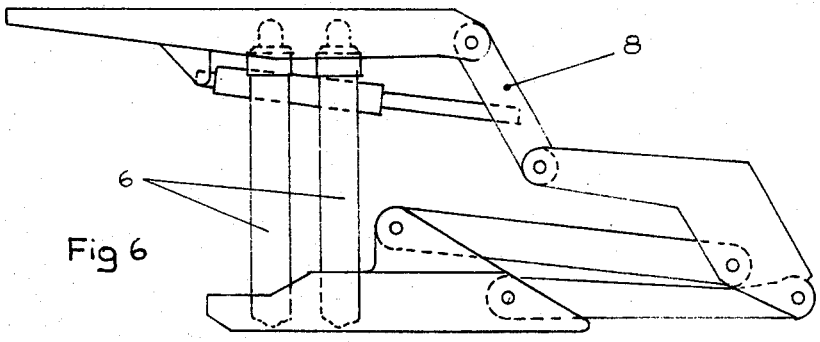
Figure 7:
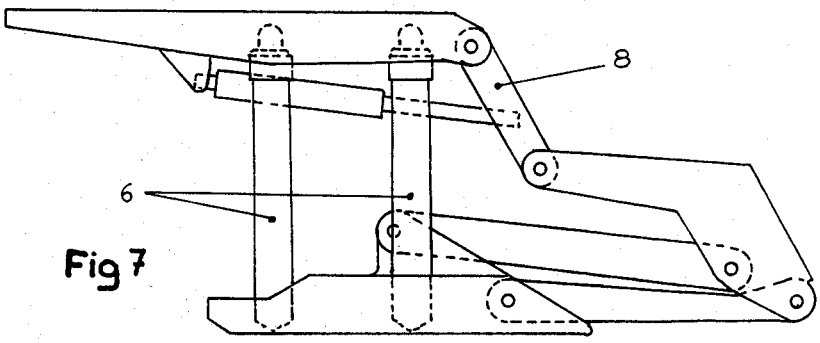
Figure 8:
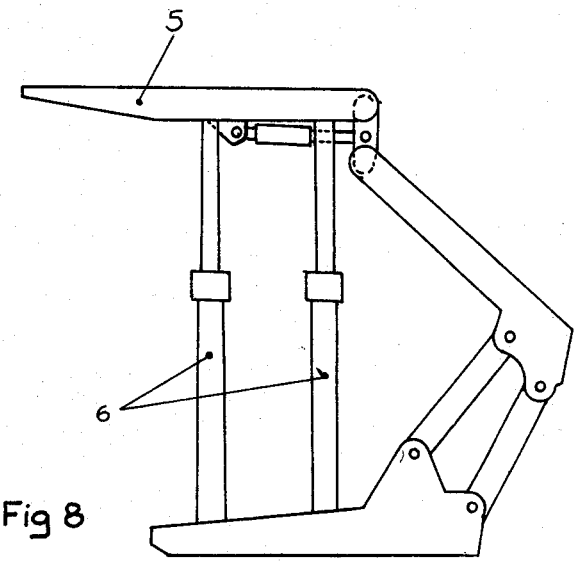

In the embodiment illustrated in FIGS. 5 to 8, the overall length 14 of the pillar in the folded condition is still further reduced by positioning the stanchions 6 more closely together when the support pillars in its collapsed position, one in front of the other as is shown in FIG. 5. To put the pillar in position, the stanchions 6 are first lifted, FIG. 6, and then the rear stanchion is moved back to its final position, FIG. 7. Finally, the stanchions 6 are caused to slide upwards, FIG. 8, until they press the top 5 against the roof 22.

Figure 9:
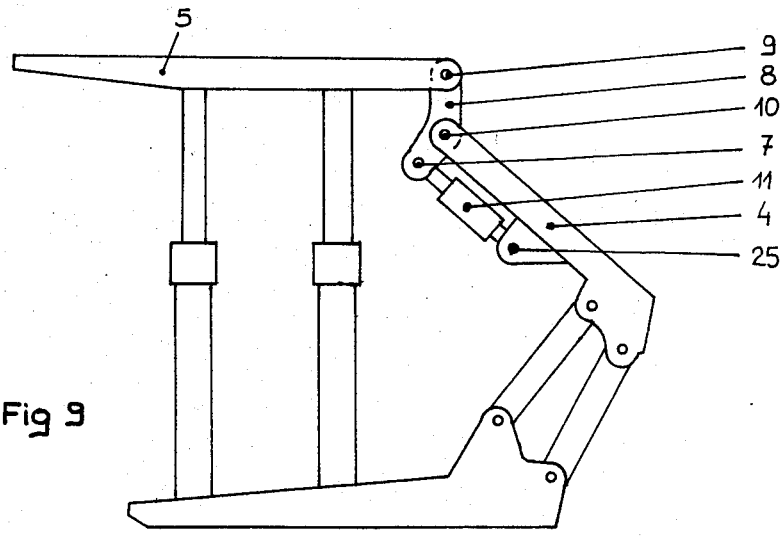
FIGS. 9 and 10 illustrate another alternative embodiment of the present invention.

In the embodiment illustrated in FIG. 9, the link 8 is still articulated around its top axis 9 through the rear of the top 5, but it is its middle axis 10 that is articulated at the top of the gate 4. In this embodiment, the bottom axis 7 of the link 8 is placed below the gate 4 to accept one end of the positioning jack 11. The other end of the hydraulic positioning jack 11 is supported at an axis 25, located on the middle part of the gate 4. In this manner, the positioning jack 11 is located below the gate or shield 4. The operation remains similar to that of the previously described embodiments.

Figure 10:
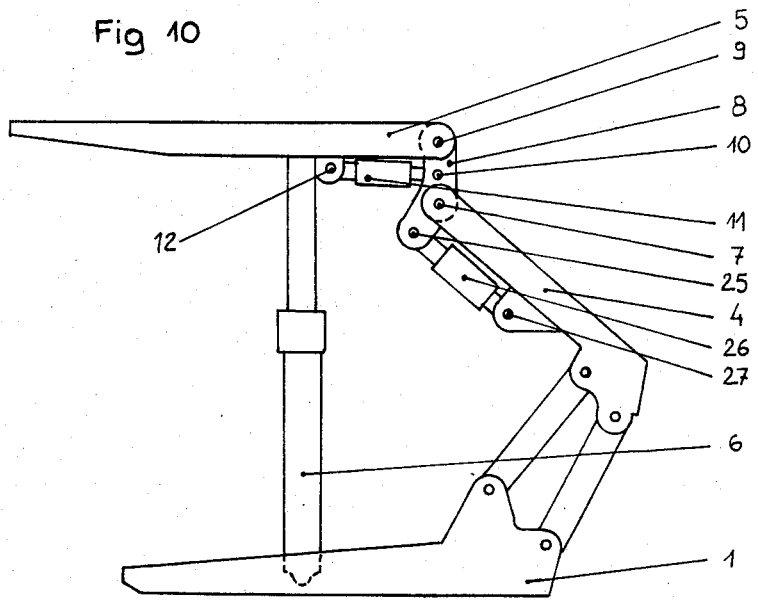

Finally, FIG. 10 shows a pillar with two stanchions. This embodiment is advantageous when the conditions for transporting the pillar to the bottom of the mine do not require a link 8 of great length. In this case, the link 8 includes four articulation axes, that is: a top axis 9 at which the link 8 is articulated to the top 5; an axis 10 that receives an end of the jack 11, the other end of which is articulated to the axis 12 of the top 5; an axis 7, below axis 10, at which the link 8 is articulated to the gate 4; and an axis 25, located at the bottom end of the link 8, at which the link 8 is articulated to an end of a positioning jack 26, the other end of which is articulated at an axis 27, placed on the inside wall of the gate 4.

It can be seen that, in this embodiment, the link 8 is subjected to the simultaneous actions of: a positioning jack 11, acting at the axis 10; and a jack 26 acting at the axis 25.

Each of the jacks 11 and 26 is hydraulically connected in the previously described manner, that is each of the jacks 11 and 26 is capable of insuring a hydraulic locking of the parts on which they act. The hydraulic locking is provided by a sliding valve that opens only in the event of overpressure, such as during the movement of the floor 21 or the roof 22.

As illustrated in FIG. 10, a single jack or a group of jacks may be inserted between the sole plate 1 and the top 5.

It will be apparent to those skilled in the art that the invention described above provides certain advantages including: an efficient support, without the risk of damage to the pillar during relative movements of the roof and the floor, even in the longitudinal direction; and easier transportation as a result of the reduced overall length 14 of the pillar, when it is in its collapsed condition.

Figure 11:
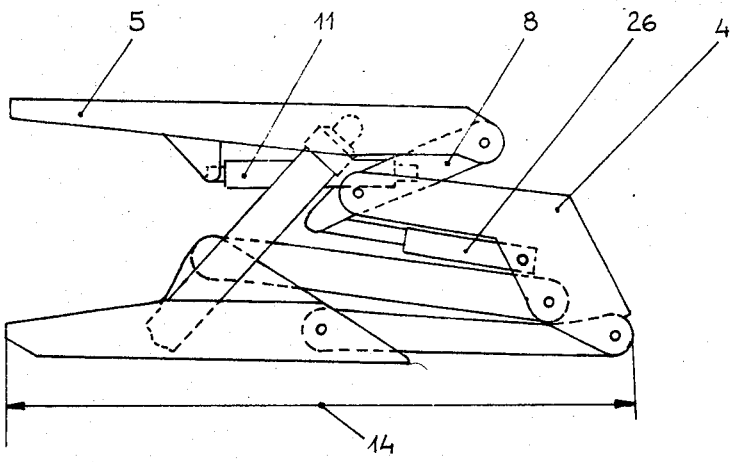
FIGS. 11 and 12 illustrate another embodiment of the present invention.
Figure 12:
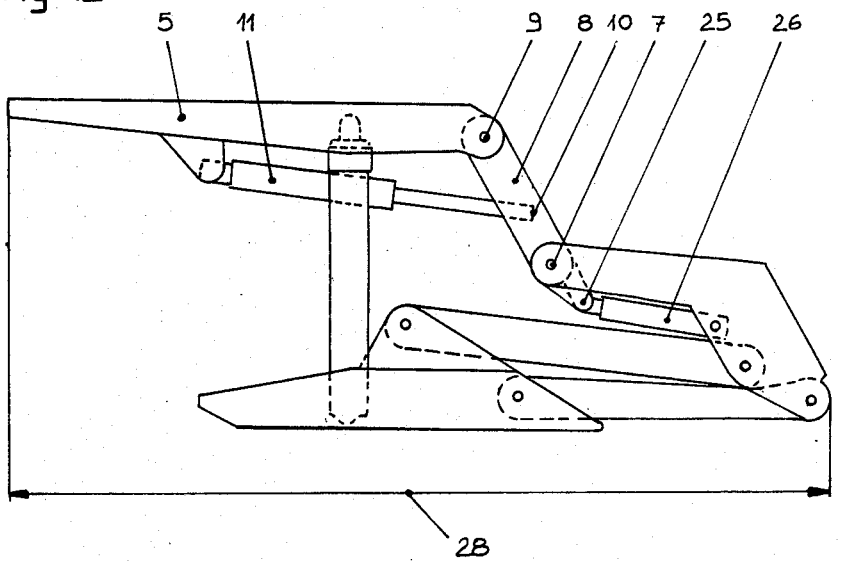

In the case of the embodiment illustrated in FIGS. 11 and 12, the structure is similar to that of FIG. 10, but the link 8 is longer. This may be needed depending on the conditions of transport to the bottom of the mine. As can be seen in FIG. 11, a longer link 8 provides a considerable reduction of the total length 14 of the collapsed pillar compared with its length 28 in the working position. See FIG. 12.

While the invention has been described with respect to a preferred embodiment and certain alternative embodiments, it should be understood that it is not intended to limit the invention to any such embodiment. On the contrary, it is intended to cover all alternatives, modifications and equivalents which may be included within the spirit and scope of the invention as defined by the appended claims.

What is claimed is:

1. A supporting pillar comprising:

a sole plate;

a top;

stanchion means extending between said sole plate and said top;

double-ended positioning deformable means in the form of a jack for positioning said sole plate with respect to said top;

shield means having a first end pivotally attached to an end of said sole plate and a second end disposed adjacent an end of said top;

a link articulated at a first axis to said end of said top, at a second axis to said second end of said shield means, and at a third axis to an end of said double-ended positioning deformable means;

said double-ended positioning deformable means being supported at its other end away from said link and constituting a device for locking said supporting pillar; and a second jack, an end of said second jack being articulated to said link at a fourth axis, said first axis of said link being at an end of said link, said fourth axis of said link being at the other end of said link, said second jack being supported at its other end on the underside of said shield means;

whereby said link is subject to movement as a result of the action of said jack and said second jack.

2. The supporting pillar according to claim 1 wherein said jack is a hydraulic jack.

3. The supporting pillar according to claim 1 wherein said third axis of said link is disposed between said first axis and said second axis.

* * * * *

UNITED STATES PATENT AND TRADEMARK OFFICE

CERTIFICATE OF CORRECTION

PATENT NO. : 4,662,796

DATED : May 5, 1987

INVENTOR(S) : Paul Fanget

It is certified that error appears in the above-identified patent and that said Letters Patent is hereby corrected as shown below:

Column 2, line 28, "jacket" should read -- jack --.

Column 3, line 25, "work" should read -- word --.

Column 3, line 41, after "5" insert a comma --, --.

Signed and Sealed this

Twenty-fourth Day of November, 1987

*Attest:*

DONALD J. QUIGG

*Attesting Officer*

*Commissioner of Patents and Trademarks*